US006774750B2

(12) United States Patent
Fujita et al.

(10) Patent No.: US 6,774,750 B2
(45) Date of Patent: Aug. 10, 2004

(54) CIRCUIT BREAKER

(75) Inventors: Hidetaka Fujita, Nakajyo (JP); Takahiro Kashima, Nakajyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/764,289

(22) Filed: Jan. 19, 2001

(65) Prior Publication Data

US 2002/0050888 A1 May 2, 2002

(30) Foreign Application Priority Data

Mar. 8, 2000 (JP) ..... 2000-068598

(51) Int. Cl.[7] ..... H01H 83/00; H01H 9/00
(52) U.S. Cl. ..... 335/46; 335/172
(58) Field of Search ..... 335/46, 41, 176, 335/172–174

(56) References Cited

U.S. PATENT DOCUMENTS 4,595,895 A * 6/1986 Fujii et al. ..... 335/26
5,041,805 A * 8/1991 Ohishi et al. ..... 335/14
5,066,935 A * 11/1991 Harper ..... 335/172
5,886,604 A * 3/1999 Kume ..... 335/172
6,087,914 A * 7/2000 Kralik ..... 335/35
6,313,723 B1 * 11/2001 Chen et al. ..... 335/6

OTHER PUBLICATIONS

Japanese Patent Examined Publication No. 1–32618.

* cited by examiner

*Primary Examiner*—Lincoln Donovan
*Assistant Examiner*—Bernard Rojas
(74) *Attorney, Agent, or Firm*—Antonelli, Terry, Stout & Kraus, LLP

(57) ABSTRACT

In order to prevent a mistrip caused by a closing operation by a toggle mechanism, a trip lever 23 is not mounted on a fixed frame of a mechanism portion 8, but is mounted on a yoke 30 of a disengaging device 9 serving as a support base for this trip lever. The mechanism portion 8 and the disengaging device 9 are held on a common casing 10, and therefore an impact force, produced at the time of closing the contact between two contacts 2 and 3 by the toggle mechanism, is not completely prevented from being transmitted to the trip lever 23, while this impact force is transmitted through the casing 10, and therefore is far smaller as compared with the case where the trip lever 23 is supported on the fixed frame 13, so that such a mistrip can be prevented.

10 Claims, 4 Drawing Sheets

CIRCUIT BREAKER

BACKGROUND OF THE INVENTION

This invention relates to a distribution breaker, having a toggle link used in an opening-closing mechanism, and more particularly to a circuit breaker in which an impact transmitted to a trip lever at the time of an on-operation is eliminated, thereby preventing a mistrip when the on-operation is effected.

Distribution circuit breaker, having a toggle link used in an opening-closing mechanism, have been extensively used, and such circuit breaker has been designed to be compact. One example is disclosed in JP-B-1-32618 entitled "WIRING BREAKER". In this conventional circuit breaker, when a movable arm mounted on an handle is rotate from an OFF position to an ON-position, a toggle link is extended under the influence of a tension spring, extending between a common shaft, interconnecting upper and lower portions of the toggle link, and the movable arm, so that a moving contact is moved to an ON-position. Once the moving contact is moved to the ON-position, a trip lever for a disengaging operation is held in an ON-position by a retaining plate unless the trip lever moves to an OFF position manually, or the trip lever is operated by an excess current, and therefore the moving contact is held in the ON-position in a stable manner.

In the above conventional technique, an impact force, which is applied to the trip lever when the handle is rotated from an OFF position to an ON position, is alleviated using a shock-absorbing tube provided on the trip lever. However, as a result of improvement of the distribution breaker so as to meet the requirement for a more compact design and the requirement for improved excess current characteristics, it has been difficult to adequately absorb this impact force. As a result, a problem arises immediately when the operator releases the handle after the ON-operation. A trip (mistrip) typically occurs.

The inventors of the present invention have made an extensive study of the causes of this mistrip, and have found that since the trip lever is held on a fixed frame supporting the moving contact of the distribution breaker, the trip lever receives vibrations when the moving contact is pressed against a fixed contact with a large impact force by the toggle link, resulting in an occurrence of mistrip. Namely, for purposes of achieving a compact design of the distribution breaker, it is effective to suitably mount the structure for driving the moving contact in one fixed frame. In this case, however, it has been found that there arises a problem that the impact force, produced by the ON-operation, is applied to all of the constituent elements.

SUMMARY OF THE INVENTION

It is an object of the present invention to provide a circuit breaker in which a trip lever is separated from a fixed frame, and is mounted on an excess current trip mechanism portion provided adjacent thereto in order to prevent tripping or mistripping.

DESCRIPTION OF THE PREFERRED EMBODIMENTS

Figure 1:
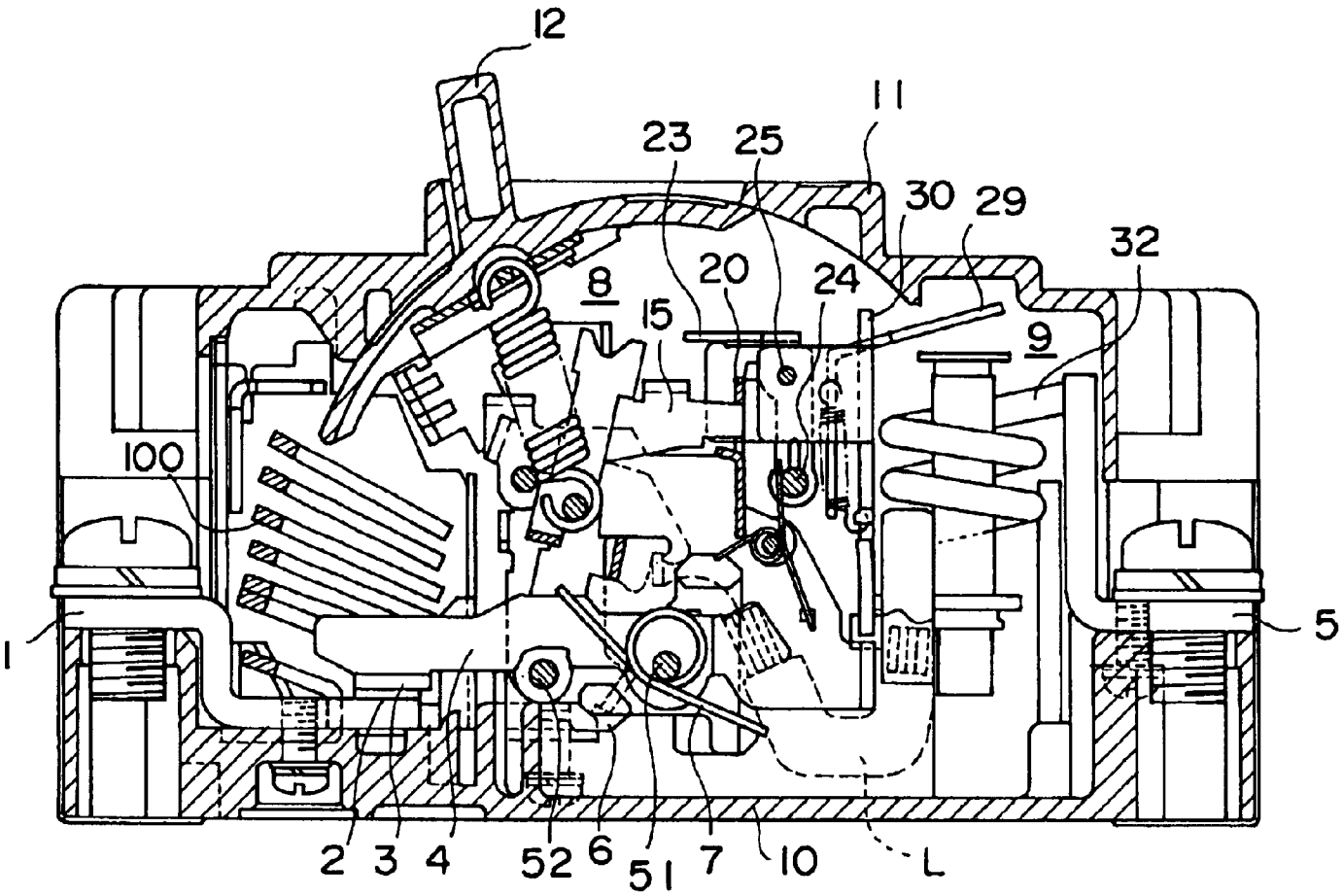
FIG. 1 is a side-elevational view of a circuit breaker in accordance with an embodiment of the present invention.
Figure 2:
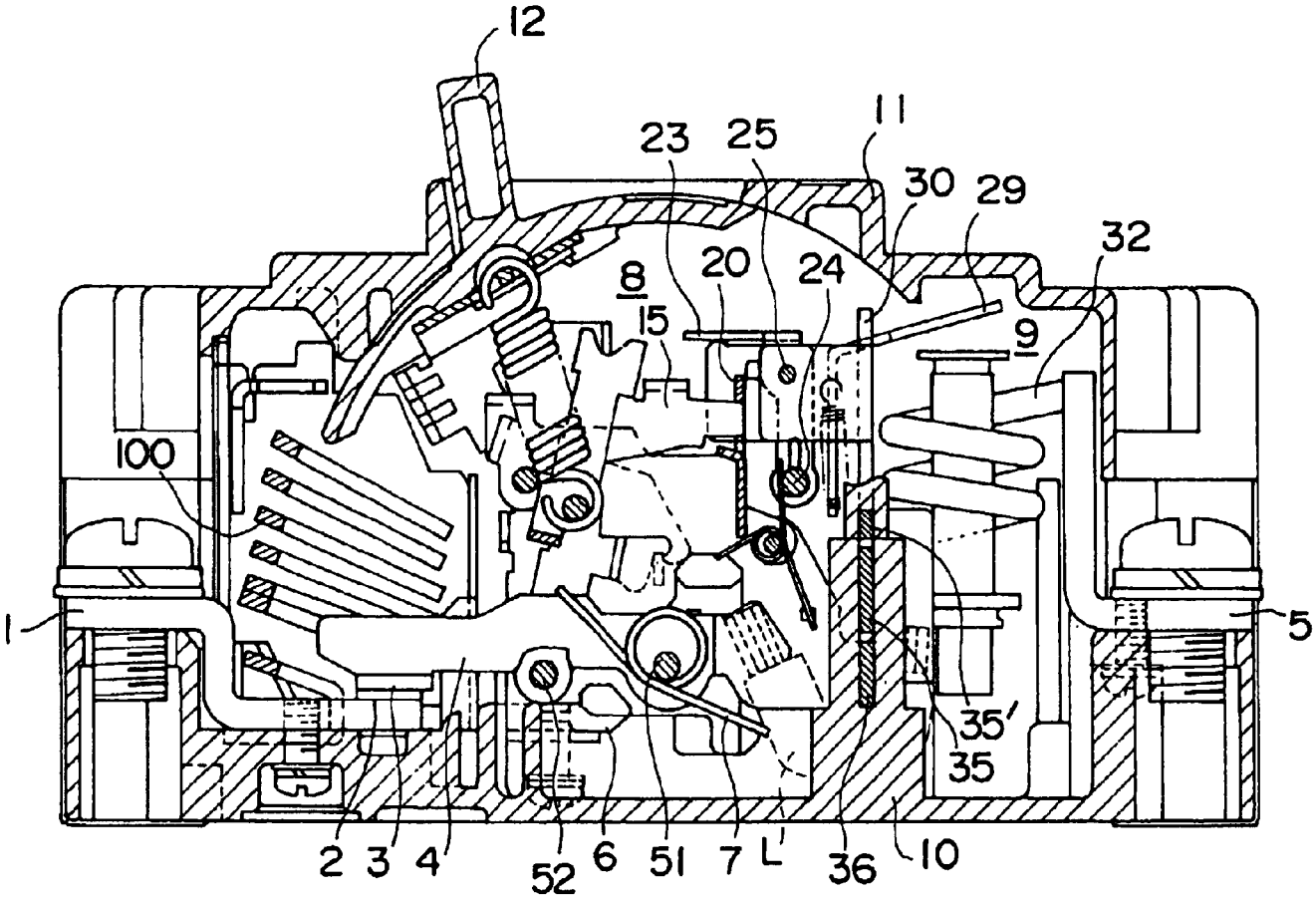
FIG. 2 is a side-elevational view of the circuit breaker in accordance with this embodiment of the present invention.

The construction of a circuit breaker in accordance with a preferred embodiment of the present invention is shown in FIGS. 1 and 2.

FIG. 1 is a side-elevational view of the circuit breaker in accordance with this embodiment, with a case 10 and a cover 11 made of an insulating plastic mold. A main circuit is formed by a power source-side terminal member 1, a fixed contact 2, a moving contact 3, a moving contact support member 4, a lead L, a coil 32, and a load-side terminal member 5. The moving contact 3 is fixedly mounted on a distal end portion of the moving contact support member 4 is pivotally mounted on a movable frame 6 by a shaft 52. An end of the movable frame 6 is pivotally mounted on a shaft 51. A force for driving the moving contact support member 4 in a counterclockwise direction is applied to the movable frame 6 by a torsion spring 7 mounted on the shaft 51. The movable frame 6 opens and closes the contact between the fixed contact 2 and the moving contact 3 by a toggle mechanism of an opening/closing mechanism 8 as more fully described later. Constituent parts of the opening/closing mechanism 8 are held on a fixed frame 13, serving as a support base for these constituent parts, as more fully described and shown in FIG. 3A. A disengaging device 9 operates in interlocked relation to the opening/closing mechanism 8. When a current, flowing through the coil 32, exceeds a predetermined value, a movable core 29, supported on a yoke 30, rotates right. A trip lever rod 24, provided at a lower end portion of a trip lever 23 of an inverted L-shape, is pushed by the movable core 29, thus rotated right, so as to rotate the trip lever 23 about a shaft 25 in a clockwise direction. As a result, a projection, formed on that portion of the trip lever 23, disposed in the vicinity of the shaft 25, is moved upward to rotate a metal trip member 20 in a right-hand direction, so that a distal end of a hook 15, engaged in a notch in the metal trip member 20, is disengaged from this notch. When the distal end of the hook 15 is thus disengaged from the notch in the metal trip member 20, the moving contact support member 4 is moved by the toggle mechanism of the opening/closing mechanism 8, thereby immediately opening the main circuit. The elements of the main circuit and the opening-closing elements of the main circuit are received in a unitary manner in the molded case 10 and the molded cover 11, and form the circuit breaker. Reference numeral 100 denotes arc travel plates which function to extinguish an arc produced between the contacts when the flow of the current is interrupted.

FIG. 2 is a side-elevational view of the circuit breaker of this embodiment, showing the cross-section thereof in part of a side wall of the case 10. As will be more fully described later, in the present invention, the trip lever 23 for canceling the latch of the opening/closing mechanism 8 is held by the disengaging device 9 so that an impact force, produced when the circuit breaker is in an ON position, will not act directly on the trip lever 23. Therefore, in order to regulate the relation between the opening/closing mechanisms 28 and the trip lever 23 which need the relatively-precise, relative structural relation with each other, a base portion of the yoke 30 is held in a groove formed in the side wall of the case 10. Except this point, FIG 2 is identical to FIG. 1.

Figure 3A:
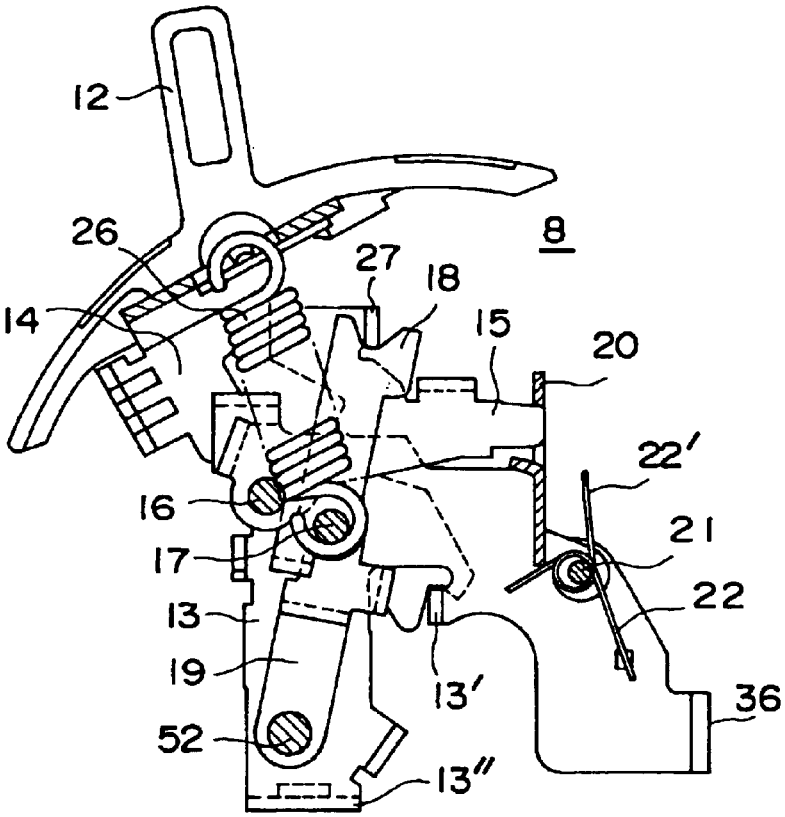
FIGS. 3A and 3B are side-elevational views respectively showing an opening/closing mechanism 8 and a disengaging device 9, which form main portions of the circuit breader in accordance with an embodiment of the present invention, as shifted right and left in corresponding relation to each other.
Figure 3B:
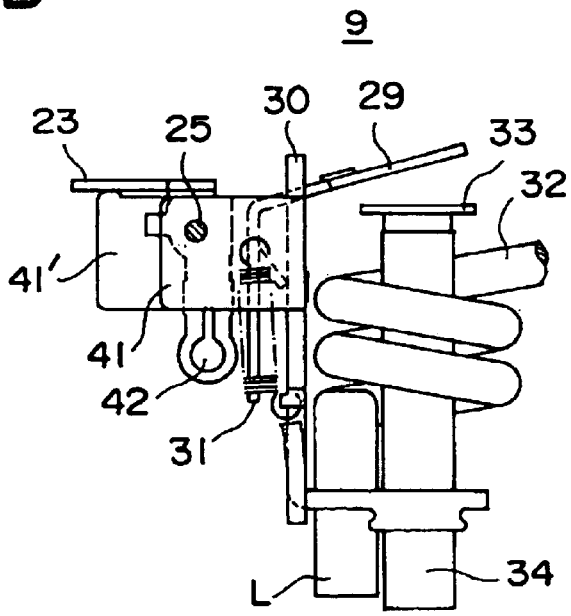
Figure 5:
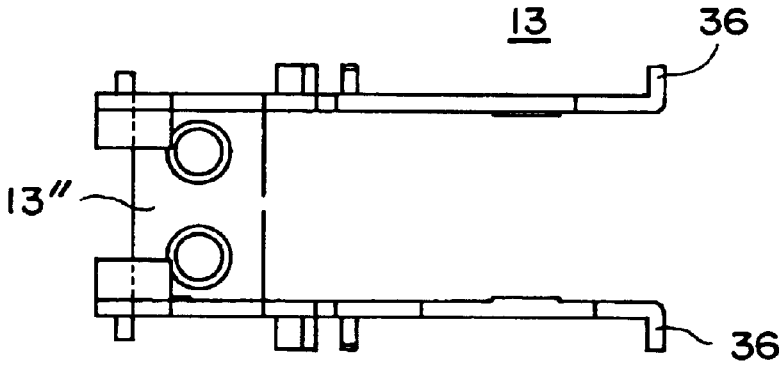
FIG. 5 is a plan view of the fixed frame including an interconnecting portion and the bent portions in accordance with an embodiment of the present invention.

FIGS. 3A and 3B are side-elevational views respectively showing the opening/closing mechanism 8 and the disengaging device 9, which form the main portions of the circuit breaker according to an embodiment of the invention, as shifted right and left in corresponding relation to each other. The parts of the opening/closing mechanism 8 are held on the fixed frame 13 serving as the support base for these parts. In addition, the fixed frame 13 also functions to determine the positional relation between these parts and the disengaging device 9. Therefore, the fixed frame 13 is formed of a one-piece plate folded or bent at an interconnecting portion 13", and the fixed frame 13 is secured at this interconnecting portion 13" to the case 10 by screws, and also the fixed frame 13 is engaged with the side wall portion of the case 10 at bent portions 36 formed respectively at end portions as shown in FIG. 5.

An operating handle 12 is connected to a handle lever 14, and this handle lever 14 is engaged with a bent portion 13' of the fixed frame 13 at one end thereof, and can be pivotally moved about a point of contact between the lever 14 and the bent portion 13'. As described above, the shaft 52, as shown in FIGS. 1 and 2, is rotatabley mounted on the movable frame 6, and is engaged with an end of a toggle link lower lever 19. A toggle link upper lever 18 and the toggle link lower lever 19 are interconnected be a common shaft 17. A drive spring 26 extends between the other end of the handle lever 14, which has the one end engaged with the bent portion 13' of the fixed frame 13, and the common shaft 17 of the toggle link.

The hook 15 is supported on a hook shaft 16, held on the fixed frame 13, so as to be pivotally moved about this hook shaft 16. A bent portion 27 is formed at an upper portion of the hook 15, and this bent portion 27 is engaged in a groove formed in a free end of the toggle link upper lever 18. When the toggle link upper lever 18 and the toggle link lower lever 19 are bent or turned at the common shaft 17 into a generally V-shape by the operation of the toggle mechanism, a pivotal center of the toggle link upper lever 18 is located at a point of contact between the bent portion 27 and the groove in the toggle link upper lever 18.

The metal trip member 20 is pivotally movably supported at one end thereof on a metal trip member shaft 21 held on the fixed frame 13. A trip spring 22 is mounted on the shaft 21, and one end of this spring 22 is engaged with the fixed frame 13 while the other end thereof is engaged with the metal trip member 20 so as to pivotally move the same in a clockwise direction. A trip prevention spring 22' is mounted on the shaft 21, and one end of this spring 22' is engaged with the fixed frame 13 while the other end thereof exerts a force to pivotally move the trip lever 23 (described later) about the trip lever shaft 25 in a counterclockwise direction. The drive spring 26 functions to pivotally move the hook 15 about the shaft 16 in the counterclockwise direction through the toggle link upper lever 18, but since the distal end of the hook 15 is engaged in the notch in the metal trip member 20, the pivotal movement of the hook 15 is prevented.

The trip spring 22 functions to pivotally move the metal trip member 20 in the clockwise direction so as to disengage the metal trip member 20 from the hook 15, but the pivotal movement of the metal trip member 20 is prevented by the projection formed on that portion of the trip lever 23 disposed in the vicinity of the shaft 25. As described above, the trip lever 23 comprises a metal member of an inverted L-shape, and can be pivotally moved about the shaft 25. Support plates 41 and 41' are held on the yoke 30, and hold the shaft 25. The support plate 41' is slightly extended to function also as a stopper for limiting the pivotal movement of the trip lever 23 in the counterclockwise direction. A through hole 42 is formed through the lower end portion of the trip lever 23, and the trip lever rod 24 is held in this through hole 42. One end of the trip prevention spring 22' is engaged with this trip lever rod 24 so as to pivotally move the trip lever 23 in the counterclockwise direction. A return spring 31 functions to rotate the movable core 29 in the counterclockwise direction.

A magnetic pole piece 33 is disposed in opposed relation to the movable core 29, and when the current flows through the coil 32 wound around the pole piece 33, this pole piece 33 functions to rotate the movable core 29 in the clockwise direction. However, when this current is lower than the predetermined value, the restraining force of the return spring 31 is larger than the force produced by the pole piece 33, and therefore the movable core 29 will not be rotated in the clockwise direction. When the current, flowing through the coil 32, exceeds the predetermined value, the force, produced by the pole piece 33, overcomes the restraining force of the return spring 31, and therefore causes the movable core 29 to rotate in the clockwise direction.

When the movable core 29 is rotated in the clockwise direction, the other end thereof pushes the trip lever rod 24 in the counterclockwise direction, thereby canceling the engagement of the hook 15 with the metal trip member 20, and as a result the toggle mechanism of the opening/closing mechanism 8 is operated to interrupt the contact between the two contacts 2 and 3. A cylinder 34 imparts time delay characteristics to the interrupting operation caused by the excessive current.

As is well known, the toggle mechanism, comprising the toggle link upper lever 18, the toggle link lower lever 19, the common shaft 17 for the two levers 18 and 19, the handle lever 14 and the drive spring 26, is held in a stable condition when the two levers 18 and 19 are disposed on a straight line as shown in FIGS. 1 and 2. On the other hand, when the hook 14 becomes disengaged from the metal trip member 20, and is pivotally moved about the shaft 16 in the counterclockwise direction, the bent portion 27 of the hook 15 moves upward, and the above relation between the toggle link uppper lever 18 and the toggle link lower lever 19 is changed, so that the lever 18 and the lever 19 are immediately bent into a generally V-shape at the shaft 17. As a result, the shaft 52 is lifted, thereby interrupting the contact between the fkixed and moving contacts 2 and 3.

Figure 4:
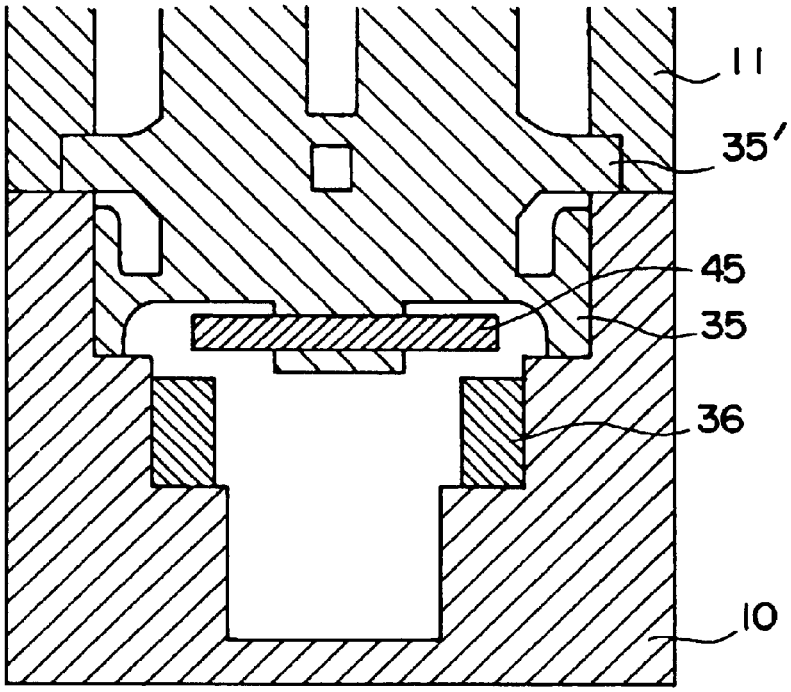
FIG. 4 is a cross-sectional view showing only those portions relevant to bent portions of a fixed frame and base portions of a yoke in accordance with an embodiment of the present invention.

As will be appreciated from FIG. 2, the bent portions 36, formed respectively at the end portions of the fixed frame 13, are engaged and held respectively in a groove formed in the casing 10. Similarly, the base portion 35 of the yoke 30 of the disengaging device 9 is engaged and held in the groove formed in the casing 10. In addition, a base portion 35' of the yoke 30 is engaged and held in a groove formed in that portion of the cover 11 disposed adjacent to the joint between the cover 11 and the casing 10. FIG. 4 is a cross-sectional view showing only those portions relevant to the bent portions 36 and the base portions 35 and 35'. In this Figure, reference numeral 45 denotes a magnetic plate interconnecting the cylinder 34 of the disengaging device 9 and the yoke 30. FIG. 5 is a plan view of the fixed frame 13, showing the interconnecting portion 13" and the bent portions 36.

With this construction, in this embodiment, the relative position between the opening/closing mechanism 8 (supported on the fixed frame 13 serving as the support base for the opening/closing mechanism 8) and the disengaging device 9 can be made highly precise in accordance with the precision of formation of the casing 10 and the cover 11. Therefore, even when the metal trip member 20 is positioned by the fixed frame 13 while the trip lever 23 is positioned by the yoke 30, the relative position between the trip member 23 and the trip lever 23 can be properly determined since the fixed frame 13 and the yoke 30 are positioned by the case 10 and the cover 11 while keeping the relative position between the fixed frame 13 and the yoke 30.

The opening/closing mechanism 8 and the disengaging device 9 are held on the common case 10, and therefore an impact force, produced at the time of closing the contact between the two contacts 2 and 3 by the toggle mechanism, is not completely prevented from being transmitted to the trip lever 23. However, this impact force is transmitted through the case 10, and therefore is far smaller as compared with the situation where the trip lever 23 is supported on the fixed frame 13. Therefore, a mistrip, caused by the opening and closing operations, can be easily prevented.

In the present invention, there can be provided the circuit breaker in which the number of the component parts, as well as the cost, is not increased, and the efficiency of the assembling operation is high, and the high reliability is obtained.

What is claimed is:

1. A circuit breaker comprising:

a main circuit formed by a power source-side terminal member, a fixed contact connected to said terminal member, a moving contact disposed in opposed relation to said fixed contact, a moving contact support member having said moving contact held at one end thereof, a coil connected to said moving contact, and a load-side terminal member connected to said coil;

an opening/closing mechanism including a fixed frame, and a toggle link mechanism supported by said fixed frame to rotate said moving contact support member so as to bring said moving contact held at one end of said moving contact support member into and out of contact with said fixed contact, when an excess current flows through said coil; and a disengaging device arranged in interlocked relation to the opening/closing mechanism, including a yoke of said coil, support plates extending from the yoke of said coil, and a trip lever mounted on the yoke of said coil, via said support plates, and separated from said fixed frame of the opening/closing mechanism.

2. A circuit breaker according to claim 1, wherein said fixed frame, serving as a support base for said toggle link mechanism, and said yoke are held by a case, and are disposed at different positions in said case, respectively, such that an impact force, generated when said moving contact is in contact with said fixed contact by said toggle link mechanism, is transmitted through said case to prevent occurrence of a mistrip.

3. A circuit breaker according to claim 2, wherein said fixed frame is a single plate having an interconnecting portion secured to said case, and two bent portions extending from the interconnecting portion that are latched onto a sidewall of said case.

4. A circuit breaker according to claim 3, wherein the yoke of said coil has a base portion held in a groove formed in the sidewall of said case.

5. A circuit breaker according to claim 3, wherein one of said support plates is extended from the yoke of said coil to serve as a stopper for limiting pivotal movements of the trip lever, as the trip lever pivots about a shaft held by said support plates.

6. A circuit breaker comprising:

a housing a main circuit formed inside the housing, by a power source-side terminal member, a fixed contact connected to said power source-side terminal member, a moving contact disposed in opposed relation to said fixed contact, a moving contact support member having said moving contact held at one end thereof, a coil operatively connected to said moving contact, and a load-side terminal member connected to said coil;

an opening/closing mechanism including a fixed frame secured to the housing, and toggle link mechanisms supported by said fixed frame to rotate said moving contact support member so as to bring said moving contact held at one end of said moving contact support member into and out of contact with said fixed contact, when an excess current flows through said coil; and a disengaging device arranged in interlocked relation to the opening/closing mechanism, including a yoke if said coil secured to the housing; support plates extending from the yoke of said coil; a trip lever mounted on the yoke of said coil, via said support plates, and separated from said fixed frame of the opening/closing mechanism; and a movable core supported on the yoke to rotate, when the excess current flows through said coil, and enable the trip lever to rotate about a shaft held by said support plates so as to interrupt the contact between said moving contact and said fixing contact by said toggle link mechanism.

7. A circuit breaker according to claim 6, wherein said fixed frame, serving as a support base for said toggle link mechanism, and said yoke are secured in the housing, and are disposed adjacently at different positions in the housing, respectively, such that an impact force, generated when said moving contact is in contact with said fixed contact by said toggle link mechanism, is transmitted through the housing to prevent occurrence of a mistrip.

8. A circuit breaker according to claim 6, wherein said fixed frame is a single plated having an interconnecting portion secured to the housing, and two bent portions extending from the interconnecting portion that are latched onto a sidewall of the housing.

9. A circuit breaker according to claim 6, wherein the yoke of said coil has a base portion held in a groove formed in the sidewall of the housing.

10. A circuit breaker according to claim 3, wherein one of said support plates is extended from the yoke of said coil to serve as a stopper for limiting pivotal movements of the trip lever, as the trip lever pivots about the shaft held by said support plates.

* * * * *